US007478673B2

(12) United States Patent
Boyd

(10) Patent No.: US 7,478,673 B2
(45) Date of Patent: Jan. 20, 2009

(54) FRAC HEAD INCLUDING A MIXING CHAMBER

(75) Inventor: Mark Dwayne Boyd, Lake Charles, LA (US)

(73) Assignee: Boyd's Bit Service, Inc., Broussard, LA (US)

( * ) Notice: Subject to any disclaimer, the term of this patent is extended or adjusted under 35 U.S.C. 154(b) by 118 days.

(21) Appl. No.: 11/544,072

(22) Filed: Oct. 6, 2006

(65) Prior Publication Data

US 2008/0083530 A1 Apr. 10, 2008

(51) Int. Cl.
*E21B 28/00* (2006.01)
*E21B 33/03* (2006.01)

(52) U.S. Cl. ..... 166/90.1; 166/177.5

(58) Field of Classification Search ..... 166/90.1, 166/177.5, 305.1
See application file for complete search history.

(56) References Cited

U.S. PATENT DOCUMENTS 4,169,504 A 10/1979 Scott
4,241,786 A 12/1980 Bullen
5,012,865 A 5/1991 McLeod
6,364,024 B1 4/2002 Dallas
6,575,247 B2 6/2003 Tolman et al.
6,899,172 B2 5/2005 McLeod et al.
7,213,641 B2 * 5/2007 McGuire et al. ..... 166/90.1

* cited by examiner

*Primary Examiner*—William P Neuder

(57) ABSTRACT

An improved frac head includes a mixing chamber located in an internal bore downstream of an intercept between the side ports and the internal bore and upstream of a tapered vortex portion of the bore. The tapered vortex reduces the diameter of the bore from a first diameter to a second diameter. The length of the mixing chamber (along the longitudinal axis of the frac head) is advantageously greater than the first diameter. The ratio of the first diameter to the second diameter is further advantageously greater than 1.5. Frac heads in accordance with this invention tend to undergo significantly reduced erosion as compared to frac heads of the prior art thereby improving service life. The invention also advantageously obviates the need for deployment of erosion resistant sleeves (or other wear resistant liners) in the interior of the frac head.

22 Claims, 4 Drawing Sheets

FRAC HEAD INCLUDING A MIXING CHAMBER

RELATED APPLICATIONS

None.

FIELD OF THE INVENTION

The present invention relates generally to a manifold-type device for receiving streams of injected fluids and directing those streams into an oilfield wellbore. More particularly, this invention relates to an improved frac head for use in well fracturing operations.

BACKGROUND OF THE INVENTION

Well fracturing operations are well known in the oil and natural gas drilling industries for increasing the flow capacity of a well. During a typical well fracturing operation, large amounts of abrasive and/or acidic fluids (slurries of sand, water, and various chemicals) are pumped down the well by high-pressure pumps. The high-pressure fluids (and sometimes gels) are intended to fracture the formation, thereby improving the permeability and flow capacity of the hydrocarbons. A frac head is typically connected to the wellhead (or above the wellhead). Multiple fluid lines connect the frac head to corresponding high-pressure pumps (typically pump trucks). The frac head acts as a manifold to collect and redirect fluid from the multiple fluid lines down through the well head into the well bore.

Owing to the abrasive (and sometimes corrosive) nature of the fracturing fluids, the interior bore of the frac head can be subject to extreme erosion. Such erosion is costly in that it can severely limit the useful service life of the frac head. The frac head wall typically needs to be sufficiently thick to support pressures up to about 15,000 psi, fluid velocities of 200 ft/min or more, and fluid flow rates of 100 gal/sec or more. Eroded frac heads can sometimes be repaired, but are often simply scrapped. Due to the high fluid pressures, frac head erosion also potentially poses a serious safety concern. Frac head ruptures are known in the art.

Numerous approaches have been taken to address frac head erosion. For example, frac heads have been fabricated from thick walled steel and/or with high-strength construction materials. The inner surface of the frac head has also been lined with various erosion resistant materials. Unfortunately these approaches have met with minimal success, most likely due in part to the extremely high pressures and fluid flow rates.

Recently, McLeod et al. (U.S. Pat. No. 6,899,172) disclosed a frac head utilizing an abrasion resistant wear sleeve deployed in the through bore of the frac head below the entry point of the side ports. The intent of the sleeve is to provide a replaceable, protective component that protects the side wall of the frac head from erosion. The sleeve is tapered (cone shaped) and held in place against a shoulder formed on the inner wall of the frac head. While the use of a replaceable sleeve may reduce erosion to the frac head side wall, it is not without drawbacks of its own. For example, removal of the sleeve can be difficult, often requiring a machine press or other time consuming operations. As stated in the McLeod patent: "the sleeve is held in place by friction, as small particles of sand fit between the sleeve in the bore of the frac head." This friction is compounded by the high pressure fluids being forced through the tapered sleeve which can act to wedge the sleeve in place. The sleeve may become wedged in so tightly that removal thereof can damage the inner wall of the frac head.

It is also possible for the wear sleeve to become dislodged from its seat due to a surge of back pressure from the well. Such pressure surges are commonly encountered in fracturing operations. The dislodged sleeve may then block one or more of the top or side ports, which can render the tool inoperable for continued use. In such an event, removal and repair of the frac head would possibly be required prior to continuing the fracturing operation, resulting in a significant loss of rig time. Moreover, in applications in which a slick or wireline tool assembly is deployed above the frac head, a dislodged sleeve may cause the tool to become stuck in the well or even lost (due to severing of the cable).

Therefore, there is a need for an improved frac head. In particular, there is a need for a frac head that resists or is substantially free from internal erosion. Moreover, such a frac head should not require time consuming and costly reworking operations (e.g., reworking of the inner surface) or replacement of various components (such as wear sleeves).

SUMMARY OF THE INVENTION

The present invention addresses one or more of the above-described drawbacks of prior art frac heads. Aspects of this invention include a frac head having a plurality of side ports of conventional construction. Aspects of the invention further include a mixing chamber located in an internal bore downstream of the intercept between the side ports and the internal bore and upstream of a tapered vortex portion of the bore, the taper reducing the diameter of the bore from a first diameter to a second diameter. In advantageous embodiments, the longitudinal distance between the side ports and the tapered portion is greater than the first diameter. In other advantageous embodiments, the ratio of the first diameter to the second diameter is greater than 1.5. In still other advantageous embodiments, the ratio of the first diameter to an inner diameter of the side ports is also greater than 1.5.

Exemplary embodiments of the present invention may advantageously provide several technical advantages. For example, frac heads in accordance with this invention tend to undergo significantly reduced erosion as compared to frac heads of the prior art thereby improving both the service life of the frac head and operational safety. Moreover, exemplary embodiments of this invention advantageously obviate the need for deployment of erosion resistant sleeves (or other wear resistant liners) in the interior of the frac head. As such, the time and expense of rework and repair are advantageously minimized.

In one aspect the present invention includes an improved frac head. The frac head includes a frac head body including an upstream end, a downstream end, and an internal bore. The internal bore has a first diameter at the upstream end and a second diameter at the downstream end, the first diameter being larger than the second diameter. The internal bore further has a tapered region between the upstream and downstream ends. The frac head further includes a plurality of side ports deployed about the frac head body that intercept the internal bore upstream of the tapered region and are disposed to produce fluid flow in a downstream direction. The frac head also includes an internal mixing chamber located within the internal bore between the side ports and the tapered region.

In another aspect this invention includes a frac head. The frac head includes a frac head body including an upstream end, a downstream end, and an internal bore. The internal bore has a first diameter at the upstream end and a second diameter at the downstream end, the first diameter being larger than the second diameter. The internal bore further has a tapered region between the upstream and downstream ends. The frac head also includes a plurality of side ports deployed about the frac head body. The side ports intercept the internal bore upstream of the tapered region and are disposed to produce fluid flow in a downstream direction. A longitudinal distance between the intercept and the tapered region is greater than the first diameter.

In still another aspect this invention includes a frac head. The frac head includes a main body portion including an internal bore having a first diameter. The main body portion further includes a plurality of side ports deployed thereabout. The side ports are inserted into corresponding side bores in the main body portion and are disposed to produce fluid flow in a downstream direction. A longitudinal distance between the side bores and a lower face of the main body is greater than the first diameter. The frac head also includes an upper body portion mechanically coupled to an upstream face of the main body portion. The upper body portion includes a top port disposed substantially coaxially with the internal bore. The frac head further includes a lower body portion mechanically coupled to a downstream face of the main body portion. The lower body includes an internal bore having a tapered region that reduces the internal bore from the first diameter to a second diameter.

The foregoing has outlined rather broadly the features and technical advantages of the present invention in order that the detailed description of the invention that follows may be better understood. Additional features and advantages of the invention will be described hereinafter, which form the subject of the claims of the invention. It should be appreciated by those skilled in the art that the conception and the specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

Figure 1A:
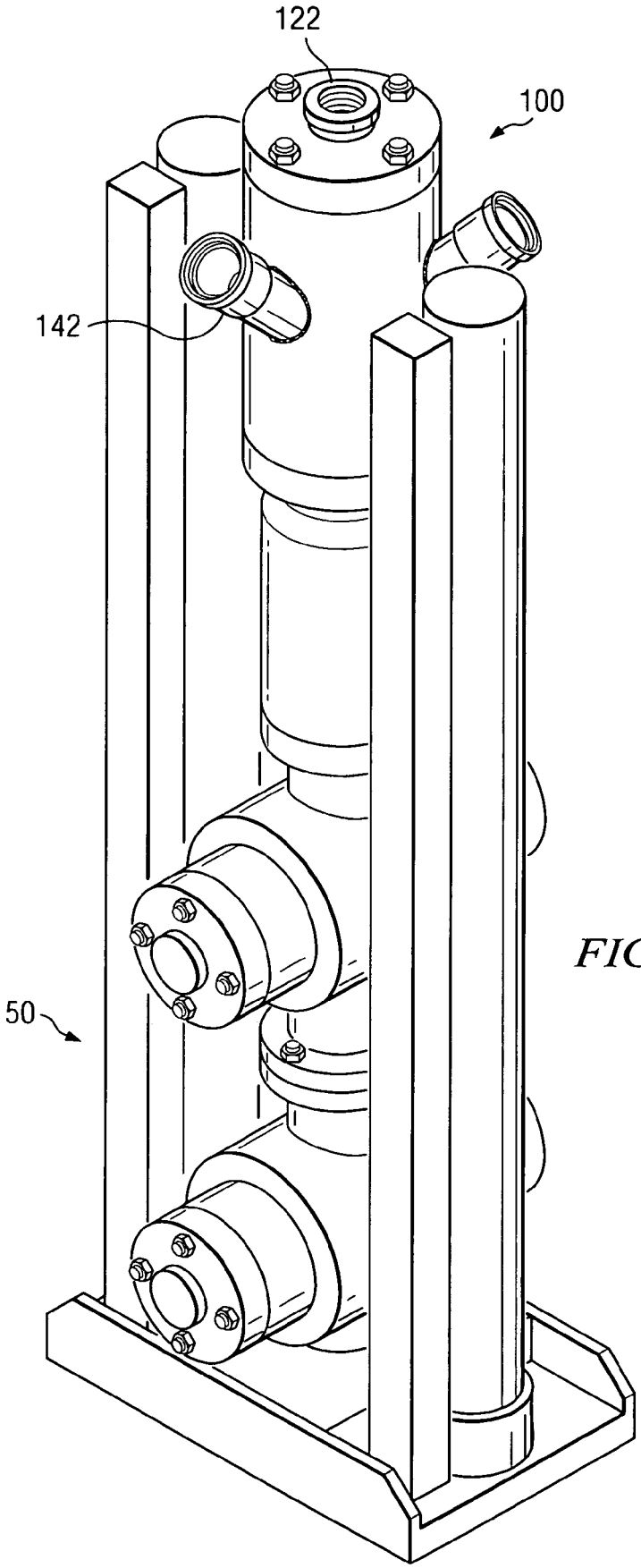
FIG. 1A depicts a perspective view of one exemplary embodiment of a frac head in accordance with the present invention deployed above a conventional isolation tool.

Referring to FIGS. 1A through 3C, it will be understood that features or aspects of the embodiments illustrated may be shown from various views. Where such features or aspects are common to particular views, they are labeled using the same reference numeral. Thus, a feature or aspect labeled with a particular reference numeral on one view in FIGS. 1A through 3C may be described herein with respect to that reference numeral shown on other views.

Figure 1B:
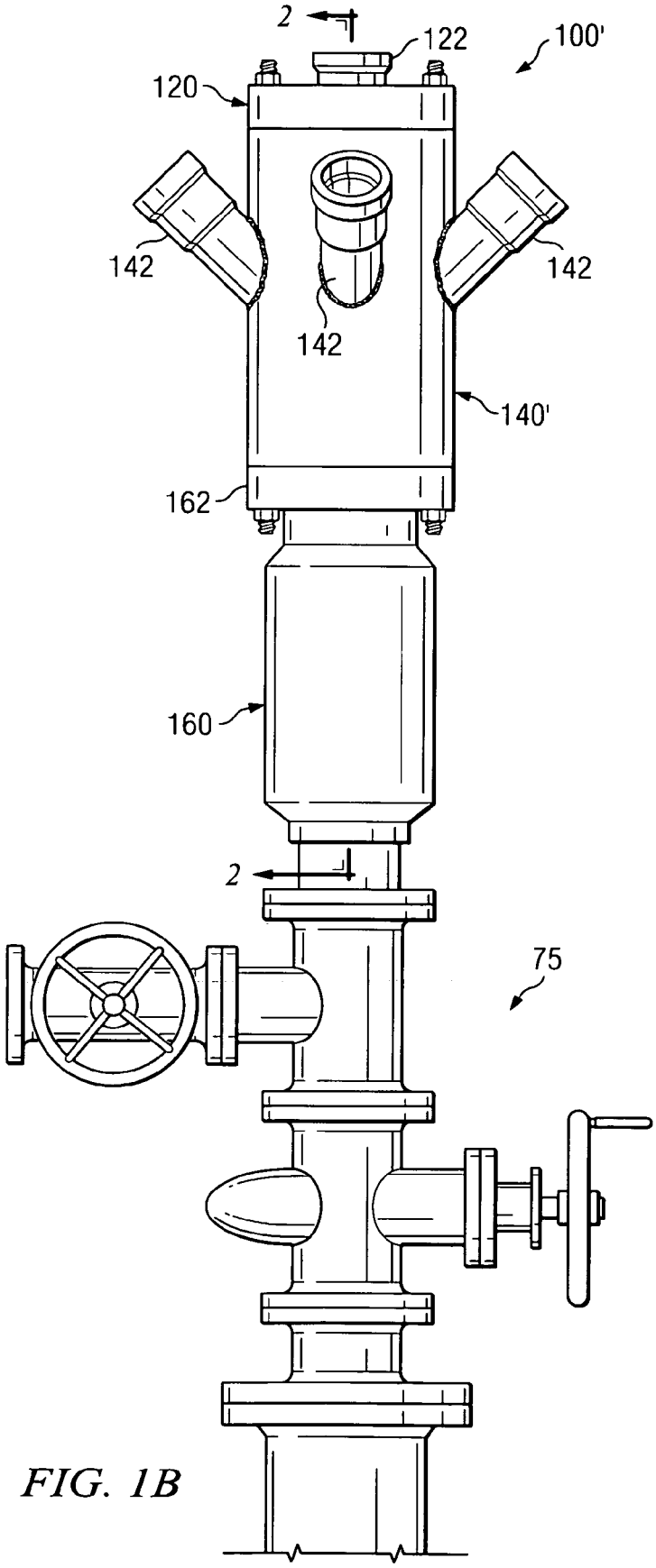
FIG. 1B depicts another exemplary embodiment of a frac head in accordance with the present invention deployed above a conventional well head.

Referring now to FIGS. 1A and 1B, exemplary embodiments of frac head apparatuses 100 and 100' in accordance with the present invention are illustrated. Frac head 100 (FIG. 1A) is depicted in perspective view coupled to the upper portion of a conventional wellhead isolation tool 50 (also commonly referred to in the art as a "tree saver"), which may be deployed, for example, directly above a conventional wellhead (not shown on FIG. 1A). Frac head 100' (FIG. 1B) is shown coupled directly to a wellhead 75 (also commonly referred to in the art as a "well tree" or a "Christmas tree"). Wellheads are known in the art to often include a series of valves (hence the reference to a well tree). The exemplary embodiment shown includes two valves. It will be understood that the invention is not limited in any way by the configuration of the well head. Nor is the invention limited in any way by the deployment configuration of the frac head above the wellhead.

Frac heads 100 and 100' include main body portions 140 and 140' (also referred to in the art as "goat heads") having a plurality of side ports 142. The exemplary embodiments shown include three (FIG. 1A) and four (FIG. 1B) side ports 142, respectively, however the invention is not limited in this regard. Frac heads in accordance with this invention may include substantially any number of side ports. Frac heads 100 and 100' may also optionally include a top port 122 as described in more detail below.

With reference now to FIGS. 2 and 3A through 3C, one exemplary embodiment of frac head 100' is shown in longitudinal cross section (along section lines 2-2 shown on FIG. 1B). In the exemplary embodiment shown, frac head 100 includes three body sections; a first, upper body 120 (also referred to as an adapter flange) deployed atop a second, main body 140', which is in turn deployed atop a third, lower body 160 (also referred to as a vortex body). Upper body 120 includes a flange 124 for mechanically coupling the upper body 120 to face 151 of goat head 140. Lower body 160 also includes a flange 162 for mechanically coupling the lower body 160 to lower face 153 of the goat head 140'. It will be understood that the invention is not limited to embodiments including multiple body portions (such as 120, 140', and 160) as shown on FIG. 2. Nor is the invention limited to threaded couplings as shown on FIGS. 1 through 3C.

With continued reference to FIGS. 2 and 3A through 3C, the exemplary embodiment of frac head 100' shown includes a top port 122 deployed atop frac head 100' and a plurality of side ports 142 of conventional construction deployed about the periphery of the frac head 100'. Advantageous embodiments typically include from 2 to 4 side ports 142, although the invention is not limited in this regard. The side ports 142 are disposed to direct flow from each of the side ports 142 downward through inner bore 148, tapered vortex 168, and lower bore 164 (and ultimately into the well). Although the invention is not limited in this regard, side ports 142 and optional top port 122 typically include a conventional hammer union for coupling with high pressure fluid lines (e.g., from one or more pumping trucks).

Side ports 142 are preferably symmetrically arranged around main body 140 or 140' (e.g., three side ports located at 120 degree intervals about main body 140 or four side ports located at 90 degree intervals about the main body 140'). Such an arrangement advantageously reduces lateral fluid flow and therefore tends to advantageously reduce frac head erosion. It is also preferable for side ports 142 to terminate at substantially the same longitudinal position in the frac head (e.g., the same vertical distance from vortex 168) such that lateral flow from one side port tends to counteract lateral flow from an opposite side port. In the exemplary embodiments shown, side ports 142 are at an angle of about 45 degrees with respect to longitudinal axis 110, although the invention is not limited in this regard. Side ports 142 are also shown welded to body portions 140 and 140'. The invention is, of course, not limited in this regard.

While the invention is not limited to embodiments having multiple body portions (such as 120, 140', and 160 described above), such a construction provides certain advantages. One such advantage is a reduction in manufacturing complexity and cost. Another advantage is that damaged body portions may be replaced individually without requiring replacement of the entire frac head. The modular configuration of frac heads 100 and 100' also endows functional advantages. For example, the modular configuration shown on FIGS. 2 through 3C allows an apparatus having a great number of side ports to be assembled. Such an apparatus may be advantageous, for example, in a fracturing operation requiring extremely high fluid pressures and/or volumes. An embodiment having 8 side ports has been assembled for one such operation. This exemplary frac head embodiment includes first and second main body portions 140' stacked atop one another (with a connecting flange deployed therebetween). The dual body portions 140' are then coupled to body portions 120 and 160 as described above and shown on FIG. 2.

Another functional advantage of the modular configuration is that conventional wireline and/or slick line tool assemblies may be mounted atop frac heads 100 and 100'. This obviates the need to remove the frac head from the well head prior to wireline and/or slick line operations and thereby saves valuable rig time. For example, in one exemplary embodiment, top port 122 may be configured to include a conventional Otis or Bowen connector. A conventional lubricator (not shown) may then be coupled to the top port. As is known to those of ordinary skill in the art, a typical slick line tool assembly includes a slick line routed through a conventional stuffing box, which is mounted atop the aforementioned lubricator. A typical wireline tool assembly includes a wireline routed through a conventional grease injection head, which is mounted atop a lubricator. In such operations, the slick line and/or wireline tool may be advantageously lowered down through frac head 100 or 100' into the wellbore.

Frac head 100' further includes a longitudinal through bore from top port 122 down through the lower end of the tool. The longitudinal through bore includes at least three sections, a first bore section 148 having an inner diameter ID1, which is located upstream of a second section, tapered section 168, which is in turn located upstream of a third bore section having an inner diameter ID2. Tapered section 168 has a reduced diameter at the downstream end thereof, reducing the inner diameter of the bore from ID1 at the upstream end of the tapered section 168 to ID2 at the downstream end of the tapered section 168 in the exemplary embodiment shown. First bore section 148 includes a mixing chamber 145 located at the lower end thereof, downstream of side port bores 144 and upstream of the tapered bore 168. As shown, mixing chamber 145 has a length d and an inner diameter ID1. The combination of the mixing chamber 145 and the tapered vortex 168 has been found to advantageously reduce erosion in frac head 100'. It is believed that the presence of mixing chamber 145 above vortex 168 serves to redirect fluid flow downhole with minimal turbulence and associated lateral fluid flow. Stated another way, the mixing chamber 145 and vortex 168 are believed to "straighten out" the fluid prior to its entry into the smaller diameter bore 164.

Figure 2:
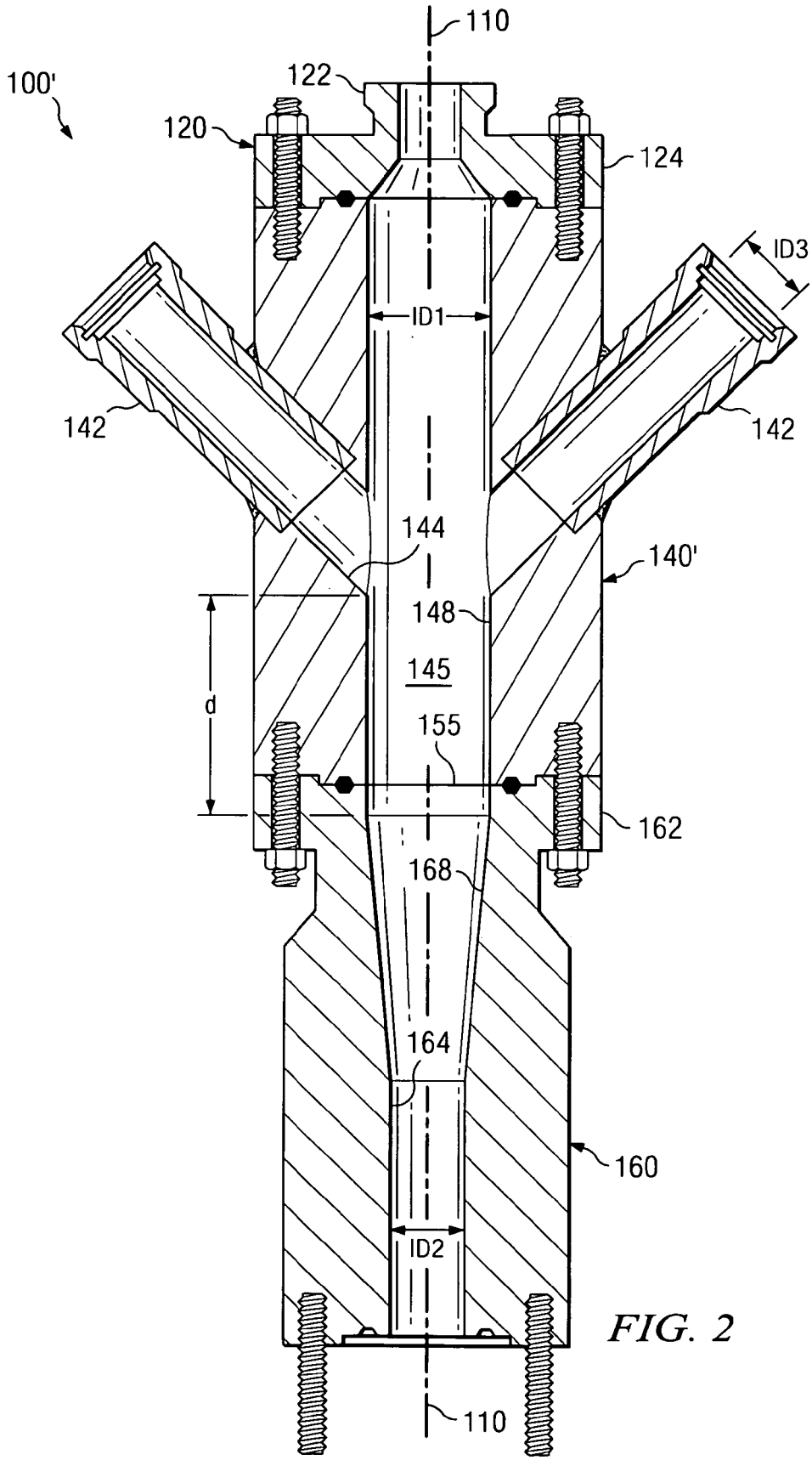
FIG. 2 depicts a cross-sectional view of the frac head shown on FIG. 1B.

With continued reference to FIG. 2 and further reference to Table 1, it has been found that the size and shape of mixing chamber 145 relative to other frac head components plays a role in erosion reduction. Mixing chamber 145 may be advantageously sized and shaped to minimize erosion caused by lateral fluid flow from side ports 142. For example, the length d of the mixing chamber 145 from the downstream end of side bores 144 to the upstream end of vortex 168 is advantageously greater than the diameter ID1 of the mixing chamber. The ratio of the length d to the diameter ID1 is most preferably greater than 2. Moreover, the ratio of the diameter ID1 of the mixing chamber 145 is advantageously at least 1.5 times that of the inner diameters ID2 and ID3 of the lower bore section 164 and side bores 144, respectively. Vortex 168 advantageously has a taper in the range from about 2 to 3 inches of diameter reduction per foot of length (i.e., from about 4 to about 8 degrees). It will be understood that the invention is not necessarily limited by any of the preferred sizes and ratios disclosed in Table 1.

TABLE I

| | Preferred | Embodiment 1 | Embodiment 2 | Embodiment 3 |
|---|---|---|---|---|
| ID1 | — | 7 1/16 in | 5 1/8 in | 5 1/8 in |
| ID2 | — | 4 1/16 in | 3 1/16 in | 2 9/16 in |
| Taper | 2 to 3 in/ft | 3 in/ft | 2 1/16 in/ft | 2 9/16 in/ft |
| D | — | 8 3/4 in | 12 in | 12 in |
| ID1/ID2 | >1.5 | 1.74 | 1.67 | 2.0 |
| ID1/ID3 | >1.5 | 1.57 | 1.55 | 1.55 |
| d/ID1 | >1.0 | 1.24 | 2.34 | 2.34 |

In the exemplary embodiment shown (FIG. 2), a portion of mixing chamber 145 is located in the downstream end of main body 140'. The remainder of the mixing chamber 145 is located in the upstream end of lower body 160 (above tapered vortex 168). While the invention is not limited in this regard, the disclosed construction is believed to be advantageous. It is believed that locating interface 155 (the interface between body portions 140' and 160 as shown on FIG. 2) a certain distance above the vortex reduces or eliminates erosion at the interface 155. However, the invention is not limited in this regard. The mixing chamber 145 may be equivalently housed in its entirety in either the main body 140' or the lower body 160. Moreover, as stated above, the invention is not limited to embodiments having multiple body portions. Suitable embodiments may also be of a unitary construction.

Figure 3A:
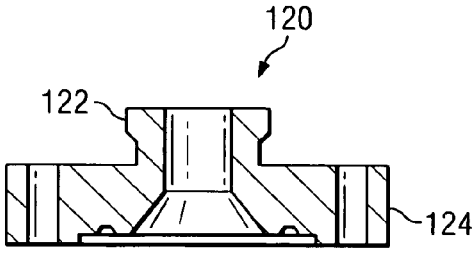
FIGS. 3A, 3B, and 3C depict cross-sectional views of top, middle, and bottom portions of the exemplary frac head shown on FIG. 1B.
Figure 3C:
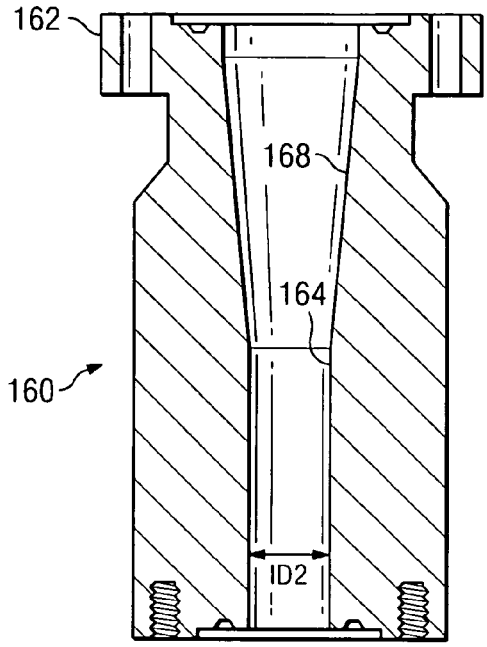
Figure 3B:
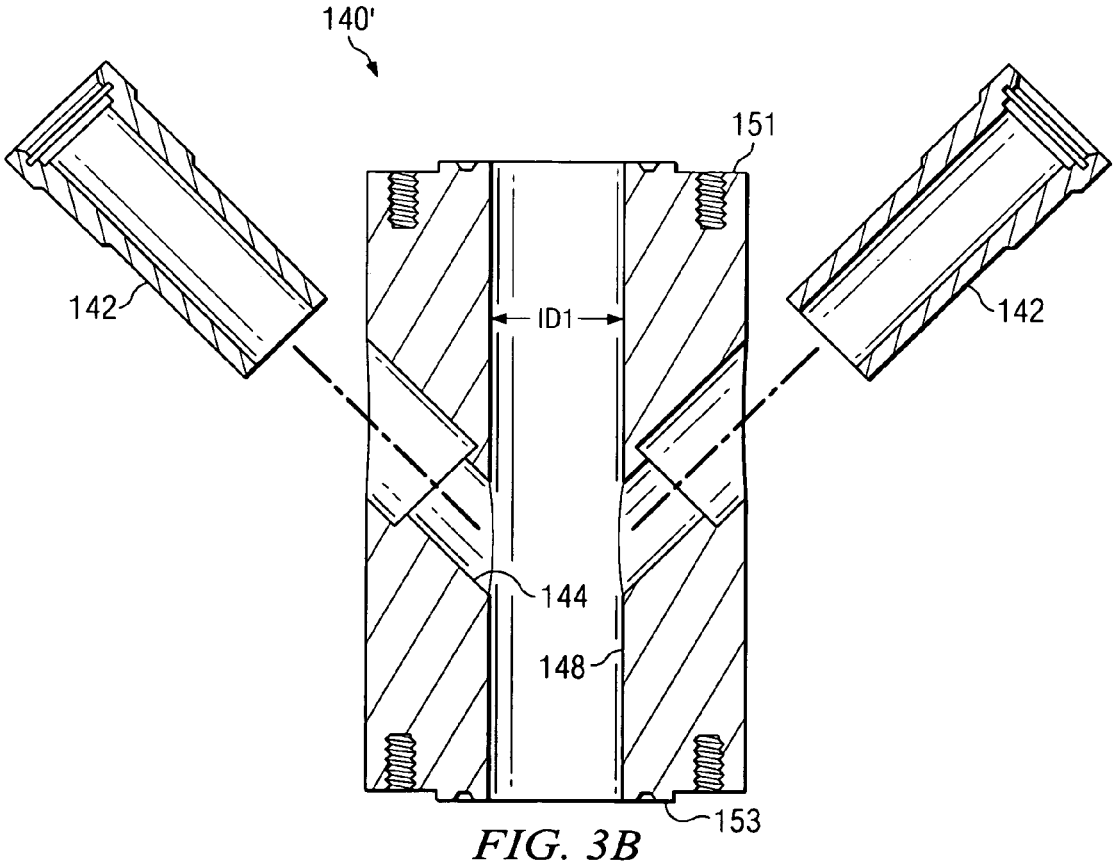

The exemplary embodiments shown on FIGS. 2 through 3C do not include any internal wear and/or erosion resistant coatings deployed on the internal surfaces of the frac heads 100, 100'. Such embodiments have been found to be suitable for typical well fracturing operations. However, the invention is not limited in this regard. It may be advantageous in selected embodiments (or for certain highly demanding applications) to employ an erosion resistant coating on certain (or all) of the internal surfaces of the frac head. For example, in one exemplary embodiment, frac heads in accordance with this invention may include a tungsten carbide, non-woven cloth based coating metallurgically bonded to selected internal surfaces, such as the vortex and mixing chamber. In one such embodiment, the tungsten carbide coating includes a Matrix3® coating available from Dyna-Drill® Technologies, Houston, Tex. Other embodiments may deploy wear-resistant coatings, such as tungsten carbide coatings deployed by other methods, such as spraying, welding, or painting, as is known in the art.

It will be appreciated that the top port 122 and/or the side ports 142 may optionally each include a wear resistant sleeve (or tube) deployed therein as is well known to those of ordinary skill in the art. Such sleeves, when utilized, are intended to minimize erosion in the top and/or side ports.

Although the present invention and its advantages have been described in detail, it should be understood that various changes, substitutions and alternations can be made herein without departing from the spirit and scope of the invention as defined by the appended claims.

I claim:

1. A frac head comprising:

a frac head body including an upstream end, a downstream end, and an internal bore, the internal bore having a first diameter at the upstream end and a second diameter at the downstream end, the first diameter being larger than the second diameter, the internal bore further having a tapered region between the upstream and downstream ends;

a plurality of side ports deployed about the frac head body, the side ports intercepting the internal bore upstream of the tapered region and being disposed to produce fluid flow in a downstream direction; and an internal mixing chamber located within the internal bore between the side ports and the tapered region, wherein a length of the mixing chamber along a longitudinal axis of the frac head is greater than the first diameter.

2. The frac head of claim 1, wherein the internal mixing chamber has a diameter substantially equal to the first diameter.

3. The frac head of claim 1, wherein the length of the mixing chamber is at least 2 times the first diameter.

4. The frac head of claim 1, wherein the first diameter is at least 1.5 times the second diameter.

5. The fine head of claim 1, wherein the first diameter is at least 1.5 times an inner diameter of the side ports.

6. The frac head of claim 1, wherein the tapered region has a taper in the range from about 2 to about 3 inches of diameter reduction per fact of length of the tapered region.

7. The frac head of claim 1, further comprising a top port deployed on the upstream end of the frac head body and substantially coaxially with the internal bore.

8. The frac head of claim 1, comprising first, second, and third frac head body portions, the first body portion including a top port, the second body portion including the plurality of side ports and an internal bore having the first diameter, the third body portion including a tapered region located downstream of a first straight bore and upstream of a second straight bore, the first straight bore having the first diameter and the second straight having the second diameter.

9. The frac head of claim 1, wherein at least one inner surface of the frac head includes a tungsten carbide erosion resistant coating.

10. A frac head comprising:

a frac head body including an upstream end, a downstream end, and an internal bore, the internal bore having a first diameter at the upstream end and a second diameter at the downstream end, the first diameter being larger than the second diameter, the internal bore further having a tapered region between the upstream and downstream ends;

a plurality of side ports deployed about the frac head body, the side ports having an intercept with the internal bore that is upstream of the tapered region, the side ports disposed to produce fluid flow in a downstream direction; and a longitudinal distance between the intercept and the tapered region being greater than the first diameter.

11. The frac head of claim 10, wherein the longitudinal distance is at least 2 times the first diameter.

12. The frac head of claim 10, wherein the first diameter is at least 1.5 times the second diameter.

13. The frac head of claim 10, wherein the first diameter is at least 1.5 times an inner diameter of the side ports.

14. The frac head of claim 10, wherein the tapered region has a taper in the range from about 2 to about 3 inches of diameter reduction per foot of length.

15. The frac head of claim 10, further comprising a top port deployed on the upstream end of the frac head body and substantially coaxially with the internal bore.

16. The frac head of claim 10, comprising first, second, and third frac head body portions, the first body portion including a top port, the second body portion including the plurality of side ports and an internal bore having the first diameter, the third body portion including the tapered region of the internal bore.

17. A frac head comprising:

a main body portion including an internal bore having a first diameter, the main body portion further including a plurality of side ports deployed thereabout, the side ports inserted into corresponding side bores in the main body portion, the side ports disposed to produce fluid flow in a downstream direction, a longitudinal distance between the side bores and a lower face of the main body being greater than the first diameter;

an upper body portion mechanically coupled to an upstream face of the main body portion, the upper body portion including a top port disposed substantially coaxially with the internal bore; and a lower body portion mechanically coupled to a downstream face of the main body portion, the lower body including an internal bore having a tapered region that reduces the internal bore from the first diameter to a second diameter.

18. The frac head of claim 17, wherein the longitudinal distance is at least 2 times the first diameter.

19. The frac head of claim 17, wherein the first diameter is at least 1.5 times the second diameter.

20. The frac head of claim 17, wherein the first diameter is at least 1.5 times an inner diameter of the side bores.

21. The frac head of claim 17, wherein the tapered region has a taper in the range from about 2 to about 3 inches of diameter reduction per foot of length.

22. The frac head of claim 19, wherein the lower body portion includes a straight bore upstream of the tapered region, the straight bore having an inner diameter substantially equal to the first diameter.

* * * * *